US005997702A

United States Patent [19]

Koganezawa et al.

[11] Patent Number: 5,997,702

[45] Date of Patent: Dec. 7, 1999

[54] OZONE GENERATING SYSTEM

[75] Inventors: Akihisa Koganezawa; Yukio Akahori, both of Shizuoka, Japan

[73] Assignee: Core Corporation, Shizuoka, Japan

[21] Appl. No.: 09/027,198

[22] Filed: Feb. 20, 1998

[30] Foreign Application Priority Data

Feb. 21, 1997 [JP] Japan ..... 9-054168

[51] Int. Cl.[6] ..... C25B 9/00; C25C 7/00; C25D 17/00

[52] U.S. Cl. ..... 204/266; 204/262; 204/263

[58] Field of Search ..... 204/262, 263, 204/266; 205/626

[56] References Cited

U.S. PATENT DOCUMENTS

| | | | |
|---|---|---|---|
| 3,616,355 | 10/1971 | Themy et al. | 204/149 |
| 5,094,734 | 3/1992 | Torrado | 204/234 |
| 5,290,406 | 3/1994 | Sawamoto et al. | 204/125 |

FOREIGN PATENT DOCUMENTS

| | | |
|---|---|---|
| 297 18 733 | 1/1998 | Germany . |
| 49-120891 | 11/1974 | Japan . |

OTHER PUBLICATIONS

Database WPI, Section Ch, Week 9351, Derwent Publications Ltd., London, GB; AN 93–411553 XP002065279, Anonymous: "Controlling temp. of electrolyser electrode e.g. ozoniser–using Peltier unit attached to electrode" * abstract * & Research Disclosure, vol. 355, No. 003, Emsworth, GB.

*Primary Examiner*—Kathryn Corgos
*Assistant Examiner*—Wesley A. Nicolas
*Attorney, Agent, or Firm*—Wenderoth, Lind & Ponack, L.L.P.

[57] ABSTRACT

An aqueous electrolyte ozone generating system includes on electrolyte tank and liquid-vapor separator tank. Electrolyte tank has a liquid supply port located at its upper part which allows ozone gas-containing liquid (generated at an anode) to be supplied to the liquid vapor separator tank. Water at the bottom part of an separator tank flows back to the anode chamber of the electrolyte tank through a return port, and fresh water is replenished to the system simultaneously while the temperature of the water in the separator tank is controlled. Liquid-vapor separator tank is thin in horizontal width and long in the vertical direction. A heat exchanger wall is installed to and covers most of the surface area of at least one side of the separator tank. A temperature control, capable of providing a cooling effect, is integrally installed to the heat exchanger wall. As water is consumed by the electrolytic reaction, the water level in the separator tank is kept constant by the addition of replenishment water to the top of the tank. Both the recirculated and replenished water are cooled when they flow to the bottom of the separator tank, and temperature control is executed based on the temperature of the water at the bottom of the separator tank as monitored by a thermocouple.

17 Claims, 3 Drawing Sheets

OZONE GENERATING SYSTEM

BACKGROUND OF THE INVENTION

1. Field of the Invention

The invention relates to an ozone generating system of the type utilizing an aqueous electrolyte.

2. Description of the Related Art

U.S. Pat. No. 3,616,355 (1971) teaches an ozone generating system which uses an aqueous media as an electrolytic solution. Japanese Kokai Patent 49-120891 (1974) teaches an ozone generating system in which an electrolytic solution, including an ozone gas component, is drawn through a fan-cooled radiator and supplied to a liquid-vapor separator where the liquid component of the aforesaid solution is returned to the electrolyte tank. More specifically, this system uses an aqueous sulfate solution as the electrolyte and operates in a manner whereby the density of the sulfate solution is maintained at a specific level through the replenishment of water therein. However, there is an inherent and undesired instability in the operation of this system caused by a temperature fluctuation which occurs after the cooled electrolyte exits the radiator at the area where the water is replenished, and another temperature fluctuation which occurs where the gas and liquid are separated. The temperature of the media flowing back to the electrolyte tank depends on the amount and temperature of the replenishment water added, and thus results in non-uniform temperatures within the electrolyte tank. This temperature fluctuation has an adverse effect on the accuracy and stability of ozone generation.

Moreover, in cases where an aqueous electrolyte is employed to generate ozone, electrolysis inducing electrodes generate significant thermal energy as a result of the large amount of electric power required, thus necessitating a means to prevent overheating of the electrolyte tank. Direct cooling devices have been employed to cool the electrolyte tank, but these devices apply stresses to the tank which can result in adverse affects to the electrolytic reaction conditions and reduced service life of the tank itself. Reduced service life of the tank is highly disadvantageous, because the electrolyte tanks used in ozone generating systems are made from costly materials, such as platinum, titanium, fluorocarbon, etc.

SUMMARY OF THE INVENTION

The invention provides means of eliminating the aforesaid shortcomings with the purpose of providing accurate and stable generation of ozone in an ozone generating system using an aqueous electrolyte.

The invention is an aqueous electrolyte ozone generating system comprised of:

- an electrolyte tank in which an electrolytic reaction occurs whereby water is consumed during the generation of ozone;
- a liquid-vapor separator tank in which the generated ozone gas is separated from the fluid electrolyte;
- a supply port installed to the aforesaid electrolyte tank so as to allow the supply of aqueous electrolyte therein;
- a fluid supply means for carrying ozone gas containing fluid to the aforesaid liquid-vapor separator tank;
- an inlet and outlet port installed to the aforesaid liquid-vapor separator tank, said inlet port having the purpose of replenishing pure water to compensate for the consumed aqueous component of the electrolytic solution, and said outlet port having the purpose of discharging the gas component;
- a electrolytic solution transport means capable of carrying the electrolytic solution to the aforesaid supply port of the aforesaid electrolyte tank;
- a heat exchanger wall, formed on a lateral side of the aforesaid liquid-vapor separator tank, which incorporates sufficient surface area so as to provide for effective cooling of the amount of liquid media capable of being held within the aforesaid liquid-vapor separator tank, the liquid-vapor separator tank being further formed as a thin structure which allows the heat exchanger wall to be placed in close proximity to an opposing wall surface;
- and a temperature control means installed to the aforesaid liquid-vapor separator tank, said control means being capable of providing a cooling function around the aforesaid heat exchanger wall.

As the aforesaid structure forms a recirculating electrolyte system in which a mixed electrolyte solution is extracted from an electrolyte tank and fed back to the electrolyte tank after passing through a liquid-vapor separator tank, and as water is simultaneously replenished to the electrolytic solution during its recirculation, a temperature control function is provided for the gas-containing fluid in the liquid-vapor separator tank by means of the operation of the aforesaid temperature control means, said temperature control function being executed after the replenishment water has been mixed into the electrolyte.

Moreover, a rapid temperature control capability is made possible because the liquid-vapor separator tank is equipped with a heat exchanger wall which has a large surface area in relation to the capacity of the separator tank. The wide heat exchanger surface enables fast cooling. Furthermore, the thin structure of the liquid-vapor separator tank allows the surface to be placed in close proximity to the opposite wall and provides for a reduction in temperature difference which is due to horizontal position difference.

The invention stabilizes the volume, temperature, and density of the electrolytic solution supplied to the electrolyte tank, and thus provides for a more stable and controlled ozone generating capability. Furthermore, as the need for installing a radiator above the liquid-vapor separator tank, as proposed in the aforesaid Japanese Kokai Patent 49-120891, is eliminated, a more compact design is made possible. As a result, the size of the entire ozone generating system can be made smaller and the number of individual components reduced. While it is possible for the electrolyte tank and liquid-vapor separator tank of a conventional electrolytic ozone generating system (capable of producing approximately one gram of ozone per hour) to be made smaller, this attempt at size reduction only creates more dead space around the radiator and lines.

DESCRIPTION OF PREFERRED EMBODIMENTS

The following discussion presents various embodiments of the aqueous electrolyte ozone generating system of the invention.

Figure 1:
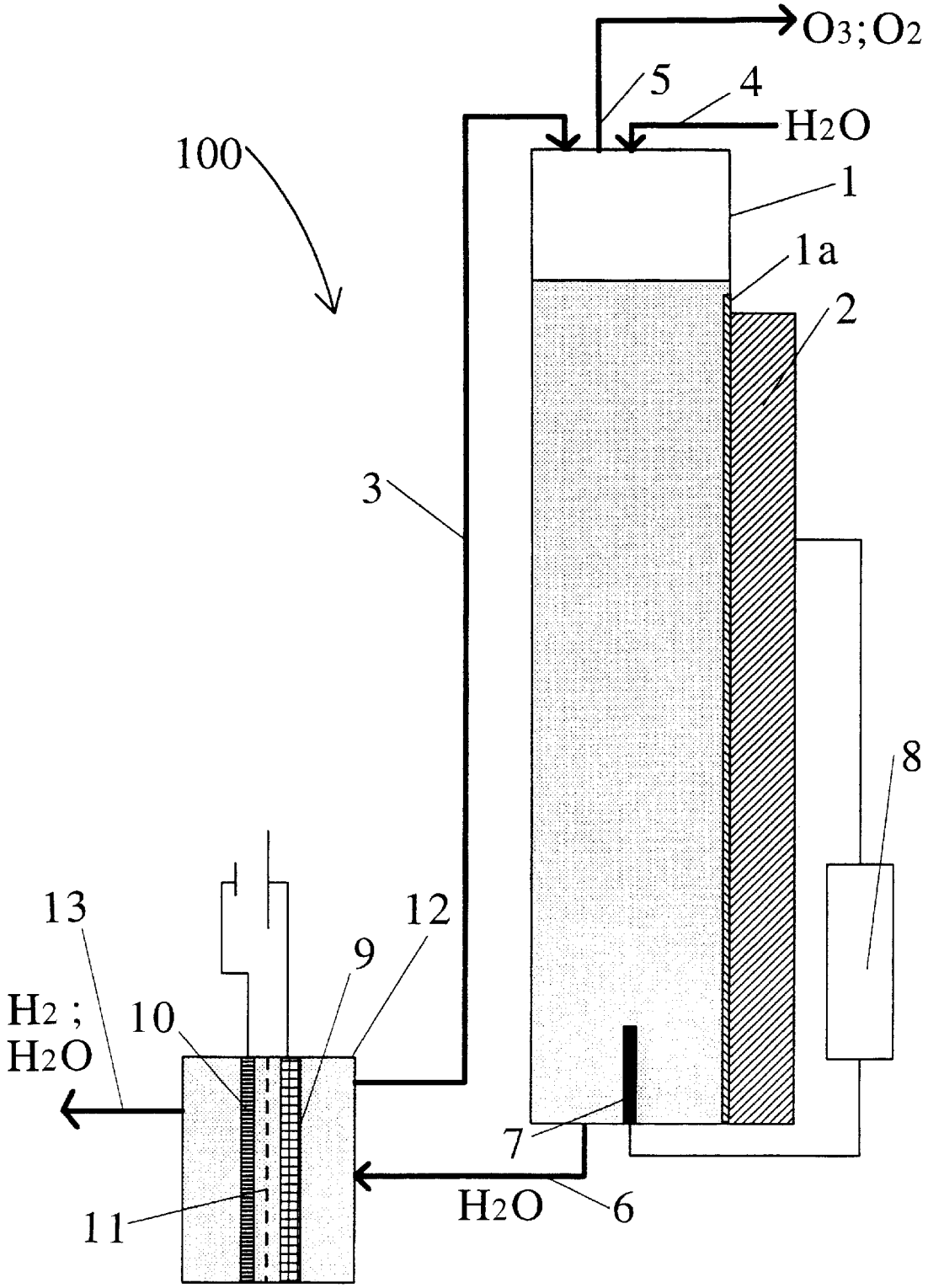
FIG. 1 shows a partial cross section, in schematic form, of an embodiment of the invention.

FIG. 1 shows complete aqueous electrolyte ozone generating system 100 as well as electrolyte tank 12 and liquid vapor separator tank 1.

In electrolyte tank 12, hydrogen gas is generated at cathode 10, and an ozone gas is generated at anode 9 as a result of a water electrolysis reaction caused by the application of a DC voltage. Separation film 11 is installed between cathode 10 and anode 9 to prevent mixture of the gasses generated at each electrode and to aid in the application of hydrogen ions to the cathode. Cathode 10 is comprised of platinum, and anode 9 of platinum and lead oxide in order to provide for adequate gas permeability. Separator film 11 is comprised of, for example, perfluorocarbon sulfonic acid which is known in the art. During the electrolysis reaction in electrolyte tank 12, hydrogen ions and water molecules flow from the anode side to the cathode side through separation film 11. Then the ions become hydrogen gas (H2) by the effect of the cathode. Both the water and the generated hydrogen gas exit at outlet port 13 on the cathode side of electrolyte tank 12.

Figure 2:
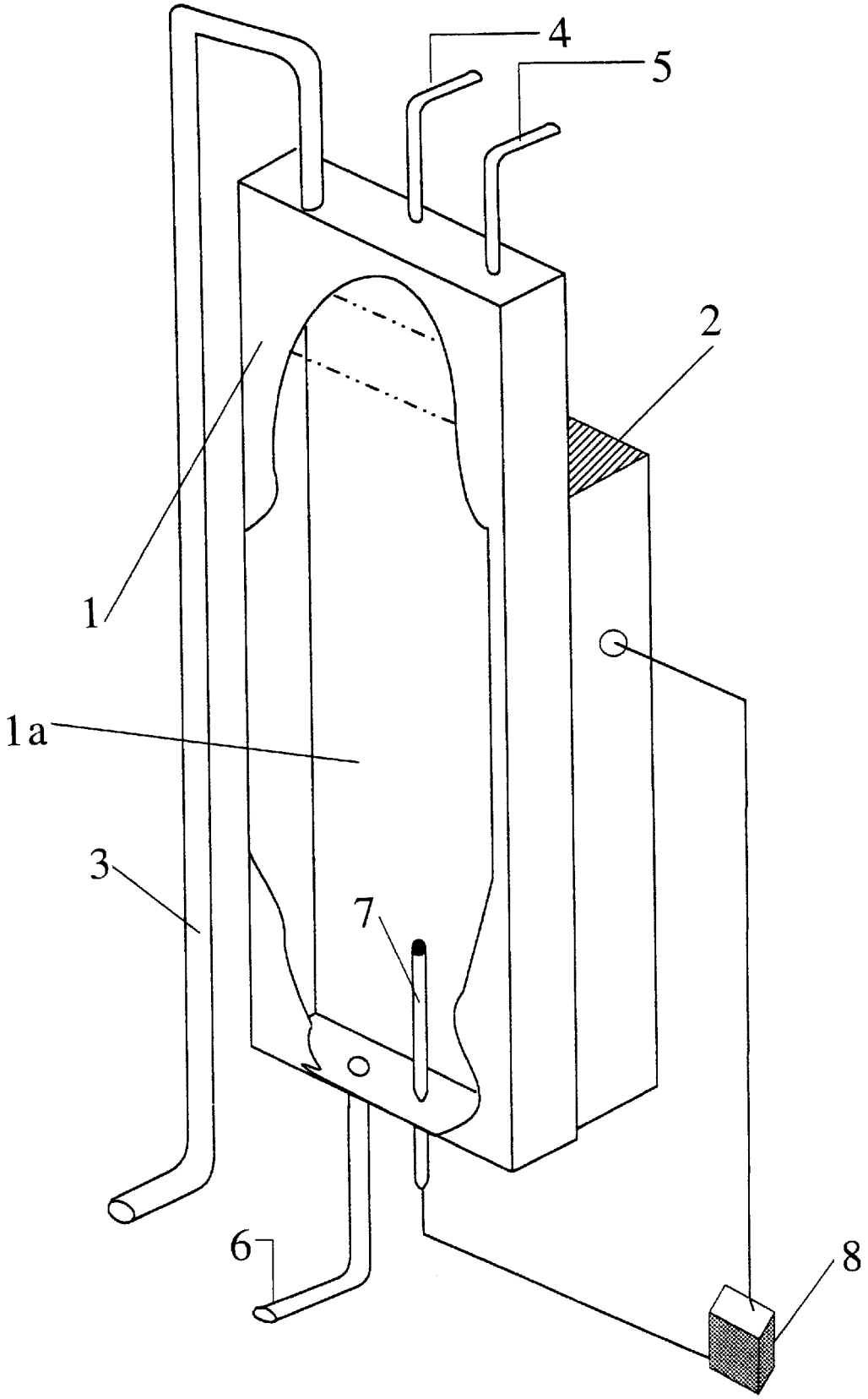
FIG. 2 shows the invention in oblique perspective with a portion cutaway.

Liquid-vapor separator tank 1 is formed as thinly as possible in one of its width or depth dimensions, but to a size which provides an adequate liquid-vapor separation effect therein. Heat exchanger wall 1*a* is installed to the side wall of liquid-vapor separator tank 1 as a means of transferring thermal energy from within the separator tank to the outside. Heat exchanger wall 1*a* is formed with an effectively large surface area, and can be incorporated as a single unit construction with a temperature control device 2 which employs, for example, a Peltier effect element. As shown in FIG. 2, it is further desirable that the thinly formed container comprising liquid-vapor separator tank 1 have upper and lower portions separated by a relatively large distance. The upper portion is equipped with gas outlet port 5 as a means of carrying out ozone containing gas, and the lower portion is equipped with a thermocouple 7 as a means of accurately measuring the temperature of the media within container 1. It is further desirable that temperature adjustment device 8 be installed as a means of controlling the operation of temperature control device 2, the temperature control operation being based on the temperature of the media monitored by temperature measurement device 7 and executed with the purpose of maintaining a desirable temperature within liquid-vapor separator tank 1. In order to reduce weight, installation space, noise, and vibration, it is desirable that the temperature control device 2 incorporate a highly efficient Peltier cooling element combined with a metal plate having the same or approximate surface area as heat exchanger wall 1*a*. Other factors relating to the ozone generating system's application may also make it desirable to employ a refrigeration chiller device if a strong cooling effect is needed, or else air, water, or other heat exchanging media if cost is a factor.

Fluid supply means 3 connects the upper internal area of the anode side chamber of electrolyte tank 12 to the internal area of liquid-vapor separator tank 1 as a means of transporting the gas-containing liquid to liquid-vapor separator tank 1. Fluid return means 6 connects the lower internal area of liquid-vapor separator tank 1 to the lower internal area of the anode side chamber of electrolyte tank 12 as a means of transporting water to the anode side chamber of electrolyte tank 12. Water replenishment means 4 is utilized to replenish the amount of water consumed in the electrolytic reaction to liquid-vapor separator tank 1. The installation of water replenishment means 4 at a point above the normal media level within liquid-vapor separator tank 1 prevents the media from backing up into means 4 and also improves the cooling effect. Certain applications of the ozone generating system, however, may allow water replenishment means 4 to be located below the media level in liquid-vapor separator tank 1 provided it does not approach the vicinity of fluid return means 6 too closely. Fluid supply means 3, return means 6, and water replenishment means 4 may be connected to various pumps, fluid adjustment devices, and other gas and/or fluid control means as the application dictates.

The ozone gas generated in electrolyte tank 12, together and in mixture with the fluid in the anode side chamber, is carried to the top part of liquid-vapor separator tank 1 through fluid supply means 3, separated from the water component therein, and discharged through the aforesaid outlet port where it can be supplied to storage means, separation and/or refining means, or to an ozone utilizing device. As ozone is a very strong oxidizer, ozone exposed surfaces of the aforesaid electrolyte tank, liquid-vapor separator tank, and fluid transport, etc., should be made from or covered by an appropriate oxidation resistant material such as fluorine resin.

Ozone produced by an ozone generating system should optimally be managed in uniform densities and amounts, from the point of initial generation to and including its final application, in order to better control its corrosive effects and potential danger to persons and living things. From this point of view it is highly desirable to simultaneously stabilize the reactive environment within the electrolyte tank and the liquid-vapor separating process. Conventional ozone generating systems do not provide means of preventing the adverse effect on reactive conditions caused by temperature fluctuations within the system, fluctuations which are induced by a water replenishment operation conducted to compensate for the water consumed in the electrolytic reaction.

The invention offers an ozone generating system in which the water remaining at the top of the liquid-vapor separator tank 1, and the replenishment water added to the top of the separator tank after the liquid-vapor separation process has been completed, flow downward and are cooled in a integrated manner. Because liquid-vapor separator tank 1 is of thin construction with a relatively small width or otherwise with a relatively small thickness, there is a correspondingly small distance between heat exchanger wall 1*a* and all of the fluid contained within the liquid-vapor separator tank, thus promoting favorable temperature control response characteristics and reduced temperature variations within the separator tank along the horizontal direction.

Moreover, even in cases where the fluid flowing into the top of separator tank 1 is at a significantly higher temperature than the water flowing out the bottom, the relatively thin construction of the tank and the efficient cooling characteristics provided by the large surface area of the heat exchanger wall prevent the fluid flowing into the top of the tank from mixing quickly with the fluid flowing out of the bottom, thus maintaining a stable and uniform low temperature condition at the bottom of the tank independent of the high temperature which may exist at the top. This effect will become even more pronounced and advantageous if the separator tank is made longer in its vertical axis. As a result of fluid flowing out of the lower part of the separator tank through return means 6, water stabilized at a desired temperature and volume can be supplied to electrolyte tank 12 with the advantageous effect that the reactive conditions in electrolyte tank 12 are further stabilized. Furthermore, as the operation of the cooling function of temperature control device 2 is based on the temperature at the lower part of separator tank 1, temperature measurement means 7 is preferably installed at the lower part of separator tank 1, and more preferably installed in the vicinity of the inlet to fluid return means 6.

Thus configured, aqueous electrolyte ozone generating system 100 provides various advantages which include an integrated, simple, and highly dependable temperature management function and a more compact overall size compared to conventional types, thus allowing the system to be installed in smaller spaces, and to be maintained with less effort.

Figure 3:
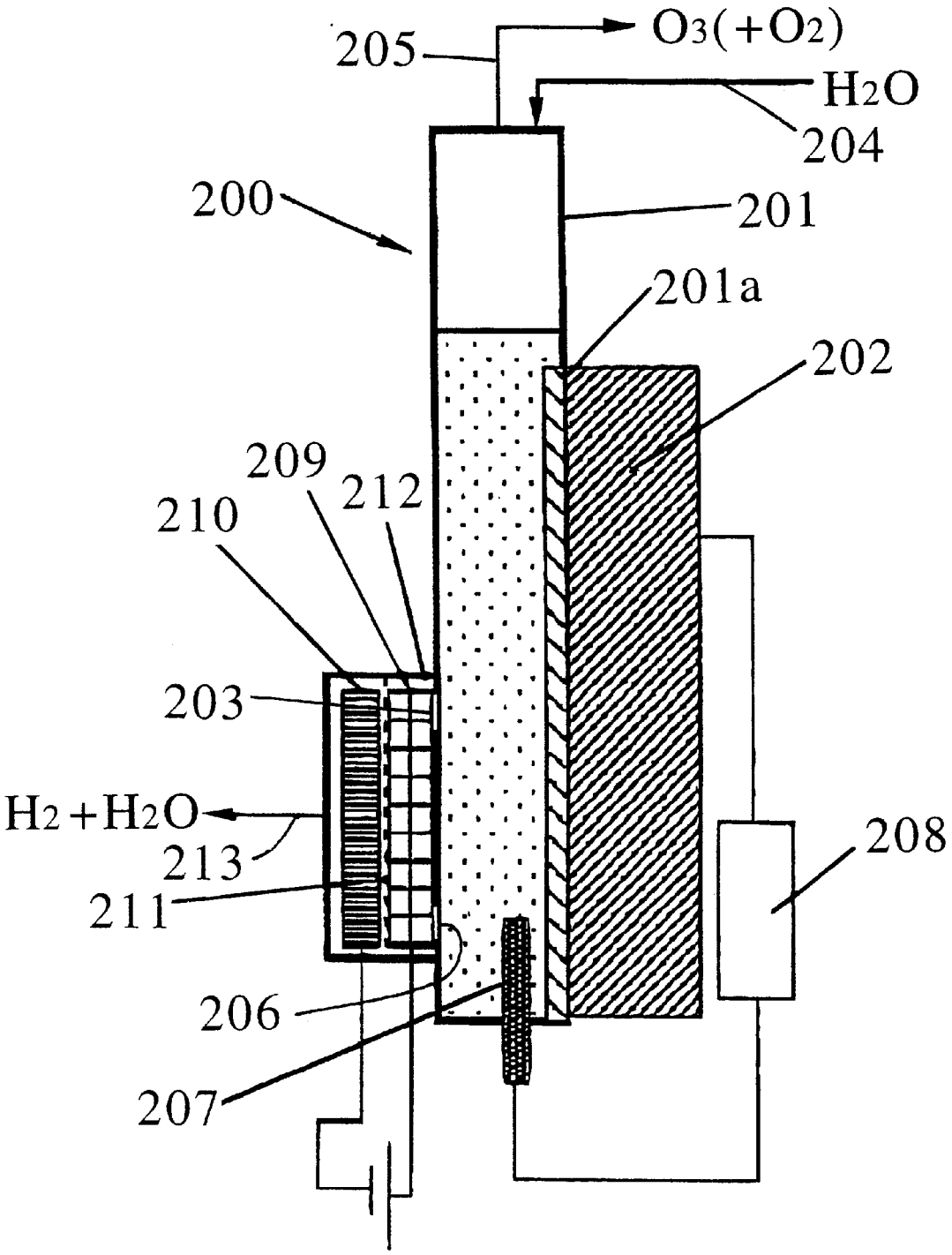
FIG. 3 shows a partial cross sectional schematic representation of an embodiment of the invention differing from that shown in FIG. 1.

FIG. 3 provides an additional embodiment of the invention, shown as aqueous electrolyte ozone generating system 200, which offers a more compact configuration than ozone generating system 100 discussed previously. The components shown in FIG. 3 are labeled in the 200 series of numerals with the last two digits corresponding to the same component numbers shown in the system in FIG. 1. The characteristics of the components shown in FIG. 1 are also embodied in the corresponding components shown in FIG. 3 unless otherwise noted.

In aqueous electrolyte ozone generating system 200, an anode chamber having anode 209 is installed to the lower lateral surface of liquid-vapor separator tank 201 opposite to heat exchanger wall 201*a*. The gas-containing liquid generated in electrolyte tank 212 is supplied to liquid-vapor separator tank 201 directly through supply port 203 which is formed within and through the side or wall of electrolyte tank 212. Return port 206 is formed below the aforesaid supply port 203 so as to allow water to return directly from liquid-vapor separator tank 201 to the anode chamber. As FIG. 3 demonstrates, supply port 203 and return port 206 create direct open passageways between the anode chamber and liquid-vapor separator tank 201, thus eliminating fluid supply means 3 and return means 6 which are utilized in the FIG. 1 embodiment. Further examination of FIG. 3 shows that the components comprising system 200 have been arranged and adjusted in a way which obtains a more compact ozone generating system as compared to the system shown in FIG. 1. System 200, while being smaller than system 100, still operates on the same principles and thus provides the same ozone generating benefits. In actual operation, a higher internal pressure is generated in the anode chamber in the vicinity of supply port 203 as a result of the generated gas rising to the top of the chamber, thus forcefully driving the gas-containing liquid into liquid-vapor separator tank 201 through supply port 203, without any pumping means. The gas rises within liquid-vapor separator tank 201 in an upward direction while simultaneously being separated from the liquid component, and is then discharged through gas discharge means 205. While not shown in the figure, the water level in liquid-vapor tank 201 is monitored through the use of a sensor, and water is replenished to the system through water replenishment means 204 in an amount corresponding to the changing liquid level monitored by the sensor. The water in liquid-vapor separator tank 201 returns to the anode chamber through return port 206. Thus, the down flow of water within separator tank 201 is continuously cooled by large size heat exchanger wall 201*a*.

Surprisingly, as a result of the operations described above, ozone generating system 200, in spite of its smaller size, and even without the absence of pumps or any other media drive means located in the vicinity of supply port 203 and lower return port 206, is able to realize the desired operation of the invention through the employment of efficient gas generation, up flow, and discharge effects in the anode chamber. As mentioned previously, these benefits are also realized by ozone generating system 100 shown in FIG. 1.

We claim:

1. An aqueous electrolyte ozone generating system comprising:

an electrolyte tank, including an anode, for generating ozone gas at said anode by a water consuming electrolysis process;

a liquid-vapor separator tank connected to said electrolyte tank to receive therefrom said ozone gas as a component of a liquid media, said liquid-vapor separator tank having an interior that is elongated laterally and vertically and that includes an upper internal portion for separation of the ozone gas from the liquid media and a lower internal portion for collection of the liquid media, and said liquid-vapor separator tank having a laterally extending wall;

an ozone gas discharge outlet for discharging the separated ozone gas from said liquid-vapor separator tank;

a water replenishment inlet for supplying into said liquid-vapor separator tank a quantity of water to replenish a component of water consumed during said electrolysis process;

a liquid transport supply to pass liquid from said lower internal portion of said interior of said liquid-vapor separator tank to said electrolyte tank;

a heat exchanger covering most of said laterally extending wall of said liquid-vapor separator tank to perform a heat exchange operation with regard to thermal energy within said interior of said liquid-vapor separator tank; and a controller connected to said heat exchanger to control operation thereof and to thus control the temperature of the liquid media in said lower internal portion, thus stabilizing electrolytic reaction conditions within said electrolyte tank.

2. A system as claimed in claim 1, wherein said liquid-vapor separator tank has a dimension in a direction transverse to said laterally extending wall that is less than the width of said laterally extending wall.

3. A system as claimed in claim 1, wherein said ozone gas discharge outlet extends from an upper portion of said liquid-vapor separator tank.

4. A system as claimed in claim 1, wherein said water replenishment inlet is connected to an upper portion of said liquid-vapor separator tank.

5. A system as claimed in claim 1, wherein said liquid transport supply is connected to an anode chamber of said electrolyte tank.

6. A system as claimed in claim 1, further comprising a supply connected between said electrolyte tank and said liquid-vapor separator tank for supply to said liquid-vapor separator tank of the ozone gas and the liquid media.

7. A system as claimed in claim 6, wherein said supply comprises a conduit.

8. A system as claimed in claim 7, wherein said liquid transport supply comprises another conduit.

9. A system as claimed in claim 6, wherein said supply comprises a port extending through a wall of said electrolyte tank and communicating directly into said interior of said liquid-vapor separator tank.

10. A system as claimed in claim 9, wherein said liquid transport supply comprises another port communicating from said interior of said liquid-vapor separator tank through said wall of said electrolyte tank.

11. A system as claimed in claim 1, wherein said electrolyte tank includes an anode chamber having said anode, and a cathode chamber having a cathode.

12. A system as claimed in claim 11, further comprising a separation film between said anode and said cathode.

13. A system as claimed in claim 11, wherein hydrogen gas is collected in said cathode chamber, and further comprising an outlet to discharge the hydrogen gas from said cathode chamber.

14. A system as claimed in claim 1, further comprising a temperature measuring device for measuring the temperature in said lower internal portion of said liquid-vapor separator tank, and a temperature adjustment device for controlling said controller as a function of the temperature measured by said temperature measuring device, thus to control the temperature of the liquid media in said lower internal portion.

15. A system as claimed in claim 14, wherein temperature adjustment device is operable to maintain a uniform fluid temperature in said lower internal portion.

16. A system as claimed in claim 14, wherein said temperature measuring device comprises a thermocouple.

17. A system as claimed in claim 1, wherein said heat exchanger and said controller are constructed together as a single unit including a Peltier effect element.

* * * * *